US008757252B2

(12) United States Patent
Franklin et al.

(10) Patent No.: US 8,757,252 B2
(45) Date of Patent: Jun. 24, 2014

(54) WELLBORE FLOW CONTROL DEVICES COMPRISING COUPLED FLOW REGULATING ASSEMBLIES AND METHODS FOR USE THEREOF

(75) Inventors: Matthew Earl Franklin, Lewisville, TX (US); Jean-Marc Lopez, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/639,194

(22) PCT Filed: Sep. 27, 2011

(86) PCT No.: PCT/US2011/053344

§ 371 (c)(1),
(2), (4) Date: Oct. 4, 2012

(87) PCT Pub. No.: WO2013/048370

PCT Pub. Date: Apr. 4, 2013

(65) Prior Publication Data

US 2013/0284452 A1 Oct. 31, 2013

(51) Int. Cl.
*E21B 43/08* (2006.01)
*E21B 34/06* (2006.01)

(52) U.S. Cl.
USPC ..... 166/205; 166/319; 166/332.1; 166/373

(58) Field of Classification Search
USPC ..... 166/374, 319, 332.1, 373, 56, 157, 205, 166/227
See application file for complete search history.

(56) References Cited

U.S. PATENT DOCUMENTS

| | | | | |
|---|---|---|---|---|
| 6,622,794 | B2 | 9/2003 | Zisk, Jr. | |
| 7,814,973 | B2 | 10/2010 | Dusterhoft et al. | |
| 7,882,894 | B2 | 2/2011 | Nguyen et al. | |
| 8,235,128 | B2 | 8/2012 | Dykstra et al. | |
| 8,261,839 | B2 | 9/2012 | Fripp et al. | |
| 8,272,443 | B2 | 9/2012 | Watson et al. | |
| 8,276,669 | B2 | 10/2012 | Dykstra et al. | |
| 8,596,366 | B2 | 12/2013 | Franklin et al. | |
| 2006/0157257 | A1* | 7/2006 | Ross et al. | 166/386 |
| 2007/0246213 | A1* | 10/2007 | Hailey | 166/278 |
| 2008/0041581 | A1 | 2/2008 | Richards | |
| 2008/0041588 | A1* | 2/2008 | Richards et al. | 166/265 |
| 2008/0283238 | A1 | 11/2008 | Richards et al. | |
| 2009/0065199 | A1 | 3/2009 | Patel et al. | |

(Continued)

OTHER PUBLICATIONS

International Search Report and Written Opinion for PCT/US20111/053344 dated Jul. 18, 2012.

*Primary Examiner* — Brad Harcourt
(74) *Attorney, Agent, or Firm* — McDermott Will & Emery LLP; Scott F. Wendorf

(57) ABSTRACT

Wellbore flow control devices can be used in various subterranean operations to regulate access of formation fluids to the interior of a wellbore pipe and/or to limit the access of unwanted fluids thereto. Coupling of flow regulating assemblies to one another in the wellbore flow control devices can result in improved operational performance in regulating formation fluid flow to the interior of the wellbore pipe compared to using the flow regulating assemblies in an uncoupled state. Wellbore flow control devices can comprise a gate valve assembly that is in fluid flow communication with a flow restricting assembly, where each assembly is located on the exterior of a wellbore pipe and the flow restricting assembly is in fluid flow communication with the interior of the wellbore pipe.

13 Claims, 8 Drawing Sheets

(56) References Cited

U.S. PATENT DOCUMENTS

| | | | |
|---|---|---|---|
| 2009/0151925 | A1 | 6/2009 | Richards et al. |
| 2011/0017458 | A1 | 1/2011 | East, Jr. et al. |
| 2011/0139453 | A1 | 6/2011 | Schultz et al. |
| 2011/0186300 | A1 | 8/2011 | Dykstra et al. |
| 2012/0048563 | A1 | 3/2012 | Holderman |
| 2013/0075112 | A1 | 3/2013 | Franklin et al. |

* cited by examiner

WELLBORE FLOW CONTROL DEVICES COMPRISING COUPLED FLOW REGULATING ASSEMBLIES AND METHODS FOR USE THEREOF

BACKGROUND

The present invention generally relates to wellbore flow control devices and their use in producing a fluid from a subterranean formation, and, more specifically, to the coupling of flow regulating assemblies for improved control of fluid access to the interior of a wellbore pipe.

It can often be beneficial to regulate the flow of formation fluids within a wellbore penetrating a subterranean formation. A variety of reasons or purposes can necessitate such regulation including, for example, prevention of water and/or gas coning, minimizing water and/or gas production, minimizing sand production, maximizing oil production, balancing production from various subterranean zones, equalizing pressure among various subterranean zones, and/or the like.

A number of apparatuses and structures are available for regulating the flow of fluids within a wellbore. Some of these apparatuses and structures are non-discriminating for different types of formation fluids and can simply function as a "gatekeeper" for regulating access to the interior of a wellbore pipe, such as a well string. Such gatekeeper apparatuses and structures can be simple on/off valves or they can be metered to regulate fluid flow over a continuum of flow rates. Other types of apparatuses and structures for regulating the flow of formation fluids can achieve at least some degree of discrimination between different types of formation fluids. Apparatuses and structures that can achieve at least some level of discrimination between different types of formation fluids can include, for example, tubular flow restrictors, autonomous inflow control devices, non-autonomous inflow control devices, ports, nozzles, tortuous paths, and the like. Autonomous inflow control devices can be particularly advantageous in subterranean operations, since they can automatically regulate fluid flow without the need for operator control due to their design. In this regard, autonomous inflow control devices can be designed such that they provide a greater resistance to the flow of undesired fluids (e.g., gas and/or water) than they do desired fluids (e.g., oil), particularly as the percentage of the undesired fluids increases. A number of autonomous inflow control device designs that are suitable for use in subterranean operations are known in the art.

Although the apparatuses and structures described above can be desirably used for regulating the flow of fluids within a wellbore, there can be certain problems encountered when doing so. In the case of on/off or metering valves, significant quantities of undesired fluids can enter the wellbore pipe. If the production of undesired fluids becomes too great, this can sometimes necessitate closing the valve to shut off production from the subterranean zone in which the valve is located. In the case of apparatuses and structures that can discriminate between various types of formation fluids (e.g., autonomous inflow control devices), the design of the apparatuses and structures can be such that if they are exposed to particular types of formation fluids or particulate matter (e.g., sand), they can become plugged or abraided such that they no longer function as intended. Plugging of the apparatus or structure can result in incomplete production from a subterranean zone. Likewise, if the apparatus or structure becomes damaged in some way, it can sometimes permit greater access of undesired fluids to the interior of the wellbore pipe than is intended.

Although the exit port of an inflow control device can be intentionally blocked to shut off fluid flow from the device, this action most often has been performed with an added structure either within the wellbore pipe or disposed between the inflow control device and the exterior of the wellbore pipe. In either case, the accompanying volume reduction can prove detrimental for production rates. In addition, such downstream regulation of the inflow control device provides no mechanism by which the device can be protected from potentially damaging conditions.

SUMMARY OF THE INVENTION

The present invention generally relates to wellbore flow control devices and their use in producing a fluid from a subterranean formation, and, more specifically, to the coupling of flow regulating assemblies for improved control of fluid access to the interior of a wellbore pipe.

In some embodiments, the present invention provides a wellbore flow control device comprising: a gate valve assembly that is in fluid flow communication with a flow restricting assembly, each assembly being located on the exterior of a wellbore pipe; wherein the flow restricting assembly is in fluid flow communication with the interior of the wellbore pipe.

In some embodiments, the present invention provides a wellbore flow control device comprising: a sliding sleeve assembly that is in fluid flow communication with a first flow pathway upstream of the sliding sleeve assembly, the sliding sleeve assembly and the first fluid flow pathway being located on the exterior of a wellbore pipe; and a flow restricting assembly that is in fluid flow communication with the sliding sleeve assembly via a second flow pathway, the flow restricting assembly and the second flow pathway being located on the exterior of the wellbore pipe; wherein the flow restricting assembly is in fluid flow communication with the interior of the wellbore pipe.

In some embodiments, the present invention provides a method comprising: installing a wellbore pipe in an uncompleted wellbore; wherein the wellbore pipe comprises at least one wellbore flow control device on its exterior, each wellbore flow control device comprising a sliding sleeve assembly that is in fluid flow communication with a flow restricting assembly, and the flow restricting assembly being in fluid flow communication with the interior of the wellbore pipe.

The features and advantages of the present invention will be readily apparent to one having ordinary skill in the art upon a reading of the description of the preferred embodiments that follows.

BRIEF DESCRIPTION OF THE DRAWINGS

The following figures are included to illustrate certain aspects of the present invention, and should not be viewed as exclusive or preferred embodiments. The subject matter disclosed is capable of considerable modification, alteration, and equivalents in form and function, as will occur to one having ordinary skill in the art and having the benefit of this disclosure.

DETAILED DESCRIPTION

Figure 1:
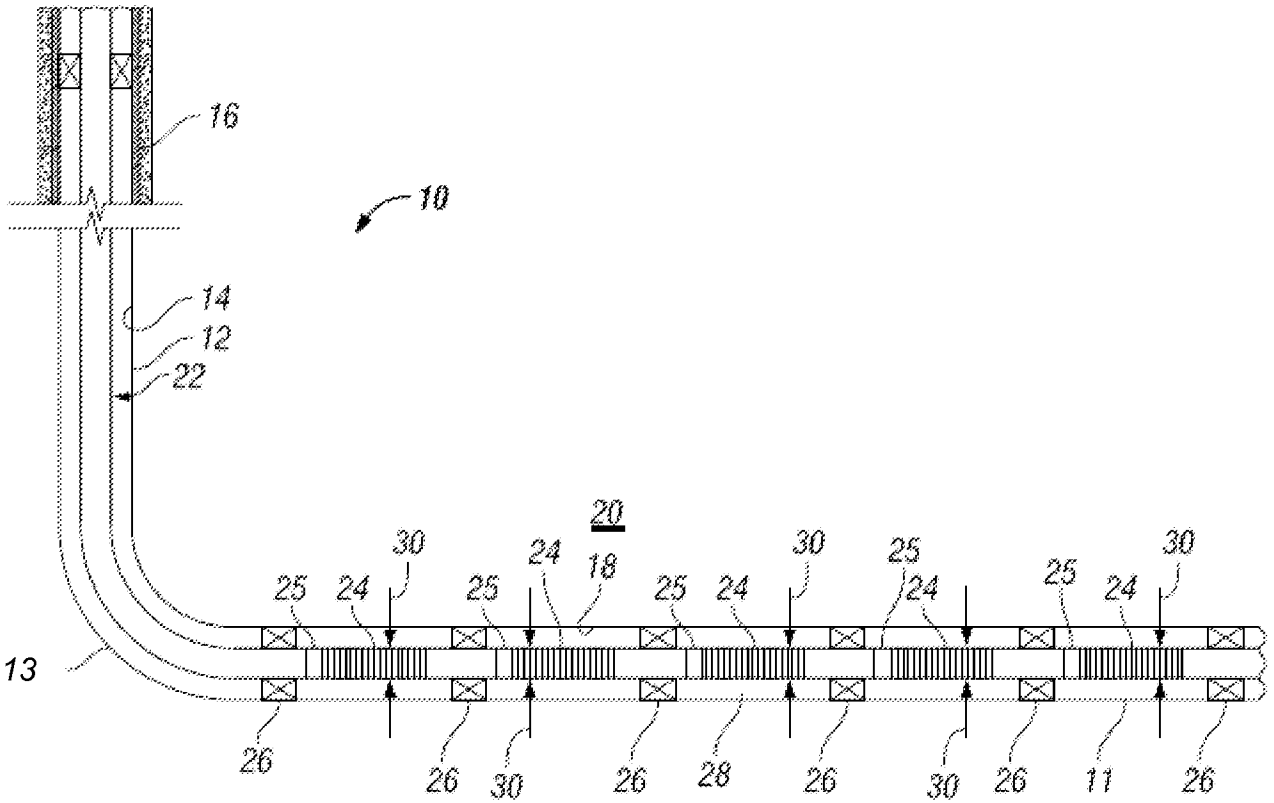
FIG. 1 shows a partial cross-sectional schematic of wellbore in which wellbore flow control devices of the present disclosure can be used.

The present invention generally relates to wellbore flow control devices and their use in producing a fluid from a subterranean formation, and, more specifically, to the coupling of flow regulating assemblies for improved control of fluid access to the interior of a wellbore pipe.

Although the use of apparatuses and structures to regulate fluid flow within a wellbore can be advantageous for production operations, particularly to regulate access of formation fluids to the interior of a wellbore pipe, there can be certain process difficulties encountered when doing so, including those described above. The wellbore flow control devices and associated methods described herein can advantageously address some of these process difficulties in order to better regulate fluid flow within a wellbore. By using the present wellbore flow control devices, more efficient production of desired fluids from a subterranean formation can be realized.

In the various embodiments described herein, two assemblies that are commonly used for regulating fluid flow within a wellbore can be placed in fluid flow communication with one another, in contrast to their more common use alone or independently of one another without fluid flow communication existing therebetween. The coupling of the assemblies together in this manner can better regulate the flow of fluids into the interior of the wellbore pipe, particularly a formation fluid during production. As used in the disclosure that follows, the term "coupled" will be used synonymously with the term "in fluid flow communication with one another" to denote a connection in this manner between two wellbore flow control assemblies. Use of the term "coupled" does not necessarily imply that a direct coupling exists between the two assemblies, nor is a direct coupling precluded. Instead, use of this term indicates that the assemblies are configured such that fluid can flow therebetween.

Specifically, we have discovered that coupling of a gate valve assembly (e.g., a sliding sleeve assembly) to a flow restricting assembly (e.g., an autonomous inflow control device) can result in better control of fluid flow within a wellbore. The combination of a gate valve assembly and a flow restricting assembly as described in the present embodiments can provide particular advantages that neither assembly can provide when used alone or individually in an uncoupled state. Fluid flow regulation of an autonomous inflow control device or like flow restricting assembly that occurs before fluid enters the assembly would allow the fluid flow through the assembly to be regulated without a volume reduction occurring, while simultaneously reducing the risk of damage to the assembly. We believe that there has been no recognition in the art of how to satisfactorily regulate fluid flow from an autonomous inflow control device in this manner, particularly using the techniques described in the present embodiments.

In addition to the foregoing advantages that can be realized by coupling a gate valve assembly to a flow restricting assembly, the gate valve assembly can be further configured to bypass the flow restricting assembly altogether if the flow restricting assembly becomes plugged, damaged or otherwise inoperable. Likewise, the flow restricting assembly can also be bypassed if there is no need to selectively restrict fluid flow into the interior of the wellbore pipe (e.g., if significant quantities of an undesired fluid are not present). Specifically, the gate valve assembly can be configured such that it is in fluid communication with both the interior of the wellbore pipe and the flow restricting assembly, although not both at the same time. By configuring the gate valve assembly in this way, the flow restricting assembly can be bypassed so that production from the wellbore can continue, even if the flow restricting assembly fails. Although bypassing the flow restricting assembly can, in some cases, result in production of an undesired fluid from the wellbore, this outcome can be more desirable than having to cease production completely due to a failed flow restricting assembly.

In some embodiments, wellbore flow control devices described herein can comprise a gate valve assembly that is in fluid flow communication with a flow restricting assembly, where each assembly is located on the exterior of a wellbore pipe and the flow restricting assembly is in fluid flow communication with the interior of the wellbore pipe. As used herein, the term "gate valve assembly" refers to an on/off or metering valve that non-selectively limits the rate of passage of all types of fluids through it.

In some embodiments, the gate valve assembly can be a sliding sleeve assembly. Illustrative sliding sleeve assemblies are described in commonly owned U.S. patent application Ser. Nos. 12/378,932; 12/566,467; and 12/617,405, each of which is incorporated herein by reference in its entirety. Sliding sleeve assemblies are well known in the art and will not be described further herein.

The design of the flow restricting assembly is not particularly limited. In general, the flow restricting assembly can be any structure that limits the rate of fluid passage through a fluid flow pathway. In some embodiments, the flow restricting assembly can be non-selective such that it limits the rate of passage of all fluid types, although not necessarily equally. In other embodiments, the flow restricting assembly can be selective such that it limits the rate of passage of certain fluids more than the rate of passage of other fluids. In various embodiments, the flow restricting assembly can regulate fluid flow selectively or non-selectively in response to the fluid velocity, viscosity and/or density when one or more of the values rises above or falls below a given level. The design of the flow restricting assembly can determine the value(s) at which the assembly begins to regulate fluid flow therethrough or the values at which the fluid flow becomes selective.

Suitable flow restricting assemblies can include, for example, autonomous inflow control devices, non-autonomous inflow control devices, reduced volume channels or tubing, nozzles, ports, any combination thereof, and the like. In some embodiments, flow restricting assembly can comprise a torturous path such that a fluid passing therethrough is impeded in its progress. In some embodiments, the flow restricting assembly can induce rotational motion in the fluid so as to impede its progress. Illustrative flow restricting assemblies that induce rotational motion in the fluid can include, but are not limited to, those described in commonly assigned U.S. patent application Ser. Nos. 12/635,612; 12/700,685; 12/792,117; 12/791,993; 12/792,146; and 12/869,836, each of which is incorporated herein by reference in its entirety.

In some embodiments, the wellbore flow control devices can further comprise a housing for the gate valve assembly and the flow restricting assembly. In some embodiments, the housing can be operatively coupled to the wellbore pipe, for example, to the exterior of the wellbore pipe. As used herein, the term "operatively coupled" is used to denote a physical connection between the housing and the wellbore pipe. However, use of the term "operatively coupled" does not imply any particular type of connection or strength of connection therebetween. In some embodiments, the housing can further comprise various flow pathways, as described in more detail hereinbelow.

In some embodiments, the wellbore flow control devices can further comprise a well screen that is in fluid flow communication with the gate valve assembly via a flow pathway that is upstream of the gate valve assembly. Illustrative well screens are well known to one having ordinary skill in the art and can include, for example, wire-wrapped well screens, sintered well screens, expanded well screens, pre-packed well screens, wire mesh well screens, and the like. Additional components such as, for example, shrouds, shunt tubes, lines, sensors, instrumentation and the like can be used in combination with the well screen, if desired. In some embodiments, the well screen can be a sand control screen, which can protect the gate valve assembly and the flow restricting assembly, as well as limit the production of sand from a subterranean formation.

In some embodiments, the interior of the flow pathway between the well screen and the gate valve assembly can be defined, at least in part, by at least one of the wellbore pipe and/or the housing for the gate valve assembly and the flow restricting assembly. In some embodiments, this flow pathway can be defined by perforated tubing on the exterior of the wellbore pipe. In some embodiments, the exterior of the flow pathway between the well screen and the gate valve assembly can be defined, at least in part, by a shroud that contains a substantially sand tight seal and connects the well screen to the housing. Accordingly, in some embodiments, fluids can pass through the well screen into this flow pathway and be transported to the gate valve assembly.

In some embodiments, the gate valve assembly and the flow restricting assembly can be in fluid flow communication with one another by a flow pathway that is separate from the flow pathway connecting the well screen and the gate valve assembly. When opened, the gate valve assembly can connect the two flow pathways and permit a fluid to flow therethrough. That is, the gate valve assembly, when open, can bridge between the flow pathways. Accordingly, the gate valve assembly can be used to regulate the flow of a fluid to the flow restricting assembly.

In some embodiments, the gate valve assembly can be further configured to divert fluid flow away from the flow restricting assembly and directly into the interior of the wellbore pipe. That is, the gate valve assembly can be at least a three-position flow controller in such embodiments. As previously described, the further configuration of the gate valve assembly to direct fluid flow away from the flow restricting assembly can be advantageous if the flow restricting assembly needs to be bypassed for any reason. In some embodiments, a normal operating position of the gate valve assembly during production could be such that a flow pathway between the gate valve assembly and the flow restricting assembly is open, and a flow pathway between the gate valve assembly and the interior of the wellbore pipe is closed. If the flow restricting assembly needs to be bypassed and it is still desirable to produce a fluid from the subterranean zone in which the wellbore flow control device is located, the gate valve assembly can be moved from its normal operating position into another operating position that still allows production to take place. Specifically, in some embodiments, the gate valve assembly can be moved such that a flow pathway between the gate valve assembly and the interior of the wellbore pipe is open and a flow pathway between the gate valve assembly and the flow restricting assembly is closed.

In some embodiments, the wellbore flow control devices described herein can extend at least partially circumferentially around the exterior of the wellbore pipe. In some embodiments, only a portion of the wellbore pipe's circumference can be covered with the wellbore flow control devices, while in other embodiments, the wellbore flow control devices can extend about the entire circumference. The number of wellbore flow control devices extending at least partially around the circumference of the wellbore pipe is not particularly limited, and is typically one or greater for a given circumferential section of the wellbore pipe. In some embodiments, between about 2 and about 20 wellbore flow control devices can extend at least partially circumferentially about a given section of wellbore pipe. As one of ordinary skill in the art will recognize, by increasing the number of wellbore flow control devices extending at least partially circumferentially about the exterior of the wellbore pipe, the amount of fluid being transported to the interior of the wellbore pipe can be increased, thereby increasing the rate of production.

In alternative embodiments, the wellbore flow control devices described herein can be housed in the exterior wall of the wellbore pipe rather than extending at least partially about the wellbore pipe's circumference on its exterior. That is, instead of the wellbore flow control devices being contained within a housing extending over the wellbore pipe, the wellbore pipe can be configured to directly house the wellbore flow control devices. One of ordinary skill in the art will recognize that the embodiments described herein can be readily modified to house the wellbore flow control devices within the exterior wall of the wellbore pipe, while maintaining fluid flow communication with the wellbore pipe's interior. Such modifications will be within the capabilities of one having ordinary skill in the art. In embodiments in which the wellbore flow control devices are housed in the exterior wall of the wellbore pipe, the wellbore flow control devices can again extend partially or completely about the circumference of the wellbore pipe.

Further, it is to be recognized that the orientation of the wellbore flow control devices is not particularly limited. In some embodiments, the wellbore flow control devices can be oriented substantially parallel to the axis of the wellbore pipe. In other embodiments, the wellbore flow control devices can be oriented substantially perpendicular to the axis of the wellbore pipe. That is, the flow pathway established by the wellbore flow control devices can be either substantially parallel or substantially perpendicular to the wellbore pipe in various embodiments. Hence, the embodiments described and depicted hereinbelow in which the wellbore flow control devices are substantially parallel to the axis of the wellbore pipe should not be considered to be limiting.

In some embodiments, the wellbore flow control devices described herein can comprise a sliding sleeve assembly that is in fluid flow communication with a flow pathway that is upstream of the sliding sleeve assembly, where the sliding sleeve assembly and the fluid flow pathway are located on the exterior of a wellbore pipe, and a flow restricting assembly that is in fluid flow communication with the sliding sleeve assembly via another flow pathway, where the flow restricting assembly and the flow pathway are located on the exterior of the wellbore pipe, and where the flow restricting assembly is in fluid flow communication with the interior of the wellbore pipe.

The wellbore flow control device embodiments set forth herein will now be described with reference to the drawings. FIG. 1 shows a partial cross-sectional schematic of wellbore in which wellbore flow control devices of the present disclosure can be used. As shown in FIG. 1, well 10 contains wellbore 12 having generally vertical uncased section 14, extending from cased section 16, and generally horizontal uncased section 18 extending through subterranean formation 20. Wellbore pipe 22 extends through wellbore 12, where wellbore pipe 22 can be any fluid conduit that allows fluids to be transported to and from wellbore 12. In some embodiments, wellbore pipe 22 can be a tubular string such as a production tubing string.

Continuing with FIG. 1, multiple well screens 24, each in fluid flow communication with wellbore flow control device 25, can be connected to wellbore pipe 22. Packers 26 can seal annulus 28 defined by wellbore pipe 22 and the interior surface of horizontal uncased section 18. Packers 26 can provide zonal isolation of various subterranean zones penetrated by wellbore pipe 22, thereby allowing fluids 30 to be produced from some or all of the zones of subterranean formation 20. Well screens 24 can filter fluids 30 as they move toward the interior of wellbore pipe 22. Each wellbore flow control device 25 can regulate access of fluids 30 to the interior of wellbore pipe 22 and/or restrict the flow of certain types of fluids 30 based upon certain characteristics thereof.

It is to be noted that the wellbore flow control devices described herein are not limited to the configuration displayed in FIG. 1, which has been presented merely for purposes of illustration. For example, the type of wellbore in which the present wellbore flow control devices can be used is not particularly limited, and it is not necessary that wellbore 12 contain either vertical uncased section 14 or horizontal uncased section 18. Furthermore, any section of wellbore 12 can be cased or uncased, and wellbore pipe 22 can be placed in any cased or uncased wellbore section. Still further, the wellbore flow control devices can be used in a wellbore containing a gravel pack, if desired.

Furthermore, it is not necessarily the case that fluids 30 are solely produced from subterranean formation 20, since fluids can be injected into subterranean formation 20 and produced therefrom in some embodiments. In addition, the various elements coupled to wellbore pipe 22 that are presented in FIG. 1 are all optional, and may not necessarily be used in each subterranean zone. In some embodiments, however, the various elements coupled to wellbore pipe 22 can be duplicated in each subterranean zone. Still further, zonal isolation using packers 26 need not necessarily be performed, or other types of zonal isolation techniques familiar to one having ordinary skill in the art can be used.

In various non-limiting embodiments, the present wellbore flow control devices can be used to prevent water coning or gas coning from subterranean formation 20. In some embodiments, the present wellbore flow control devices can be used to equalize pressure and balance production between heel 13 and toe 11 of wellbore 12. In other embodiments, the present wellbore flow control devices can be used to minimize the production of undesired fluids and maximize the production of desired fluids. It is also to be recognized that the wellbore flow control devices can be used for injection operations as well to accomplish similar advantages to those noted above.

Whether a fluid is a desired fluid or an undesired fluid will usually be determined by the nature of the subterranean operation being conducted. For example, if the goal of a subterranean operation is to produce oil but not natural gas or water, the oil can be considered a desired fluid and the natural gas and water can be considered undesired fluids. Likewise, in some embodiments, gas can be a desired fluid, and water can be an undesired fluid. It should be noted that at downhole temperatures and pressures, natural gas can be at least partially liquefied, and in the disclosure presented herein, the terms "natural gas" or more simply "gas" will refer to a hydrocarbon gas (e.g., methane) that is ordinarily in the gas phase at atmospheric pressure and room temperature.

Figure 2A:
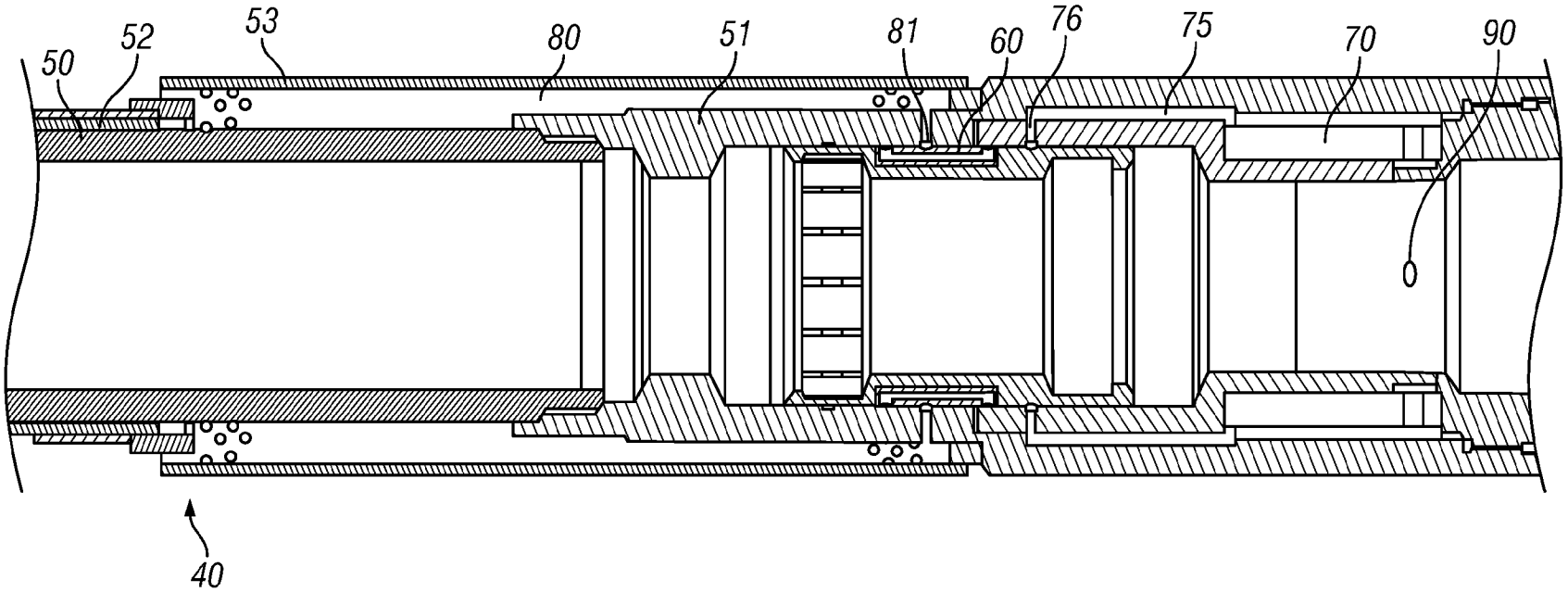
FIGS. 2A and 2B show a cross-sectional schematic of an illustrative wellbore flow control device according to the present disclosure.
Figure 2B:
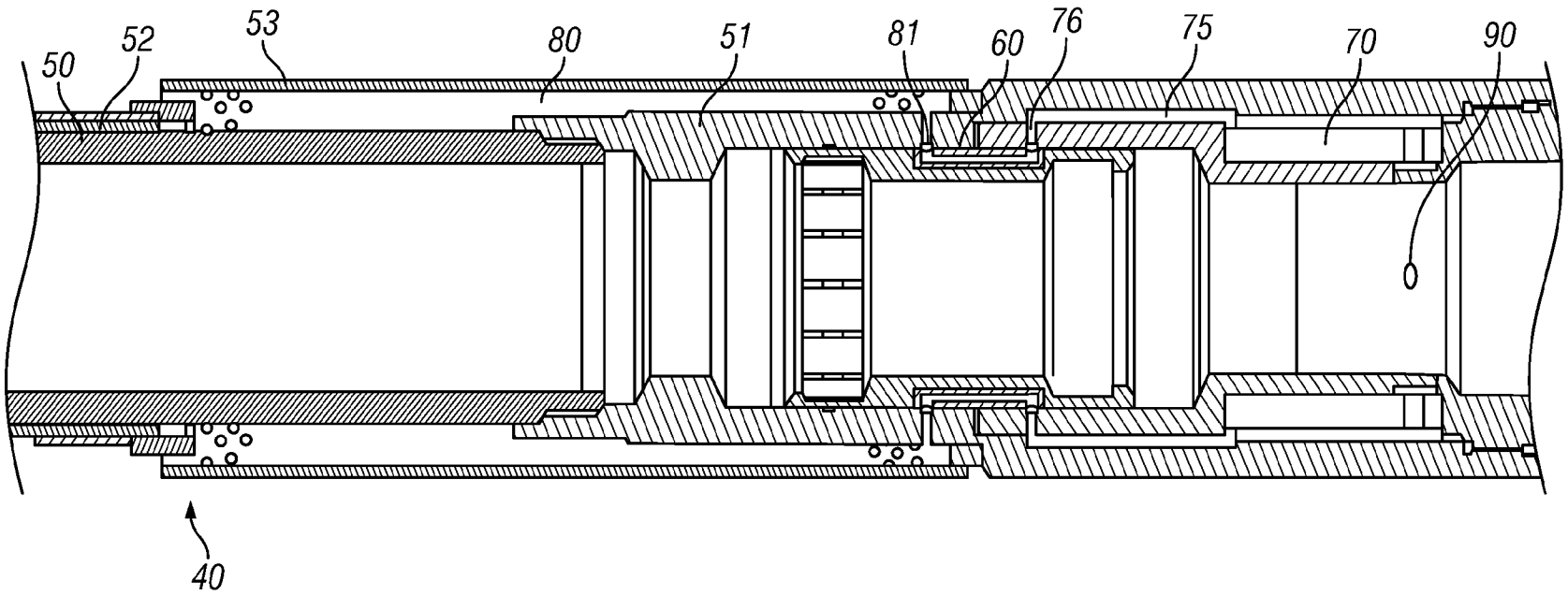

FIGS. 2A and 2B show a cross-sectional schematic of an illustrative wellbore flow control device 40 according to the present disclosure, where the gate valve assembly is in the closed position in FIG. 2A and open in FIG. 2B. In the embodiment shown in FIGS. 2A and 2B, the gate valve assembly is a sliding sleeve assembly. It is to be recognized in view of the description provided above that a sliding sleeve assembly should be considered an illustrative gate valve assembly, and any structure capable of similarly directing fluid flow to the flow restricting assembly and, optionally, the interior of the wellbore pipe can be used within the spirit and scope of the present disclosure. Thus, any embodiment specifically described herein using a sliding sleeve assembly can be similarly practiced with a different type of gate valve assembly.

As shown in FIGS. 2A and 2B, wellbore pipe 50 is operably coupled to housing 51, which contains sliding sleeve assembly 60 and flow restricting assembly 70 that are in fluid flow communication with one another via flow pathway 75. Wellbore flow control device 40 further contains sand control screen 52, which is in fluid flow communication with sliding sleeve assembly 60 by flow pathway 80. As shown in FIGS. 2A and 2B, the interior surface of flow pathway 80 is partially defined by wellbore pipe 50, housing 51 and shroud 53, which can further inhibit entry of sand and other debris into flow pathway 80.

Figure 2C:
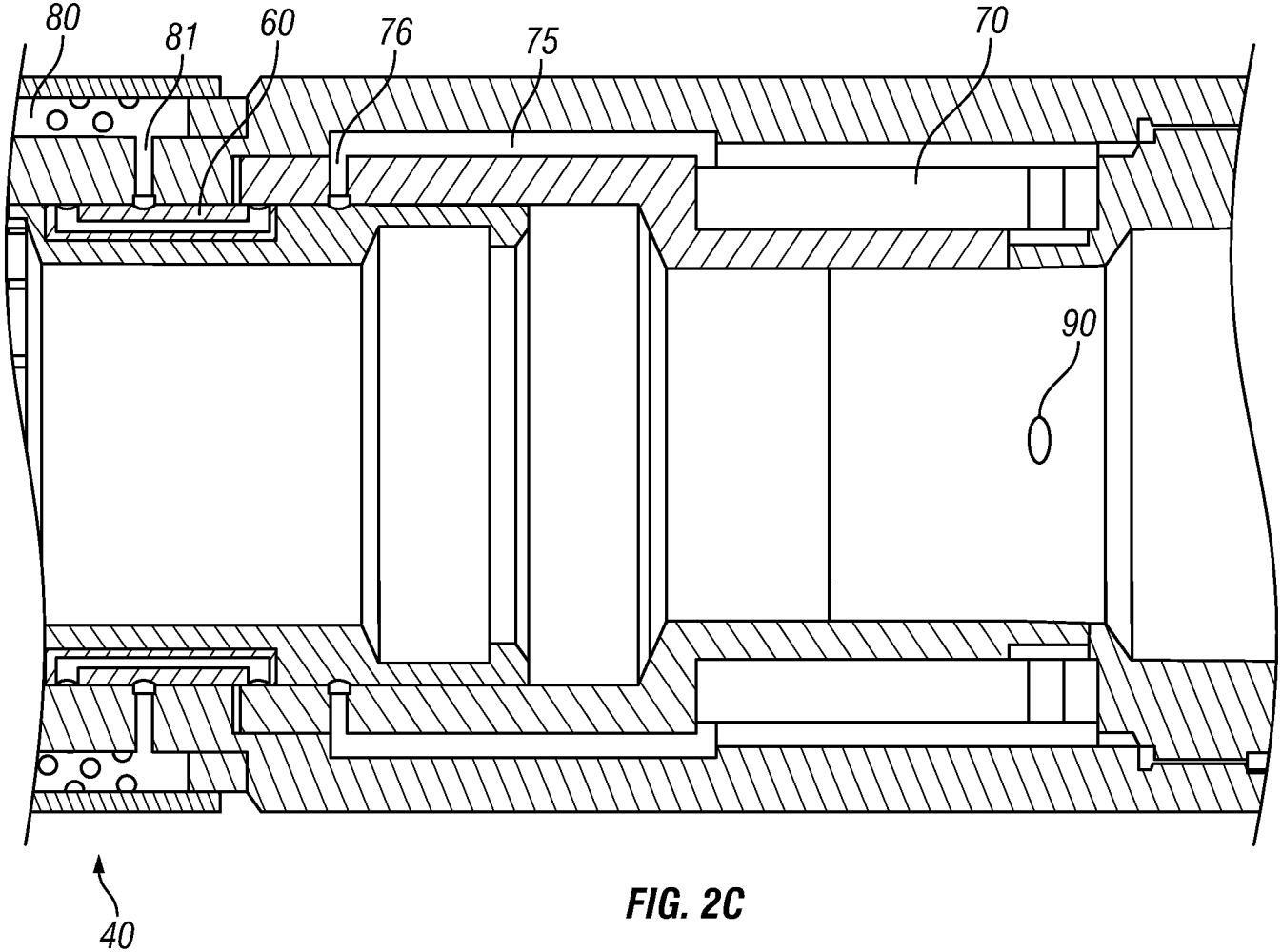
FIG. 2C shows an expansion of the sliding sleeve assembly of the wellbore flow control device when the sliding sleeve assembly is in the closed position.
Figure 2D:
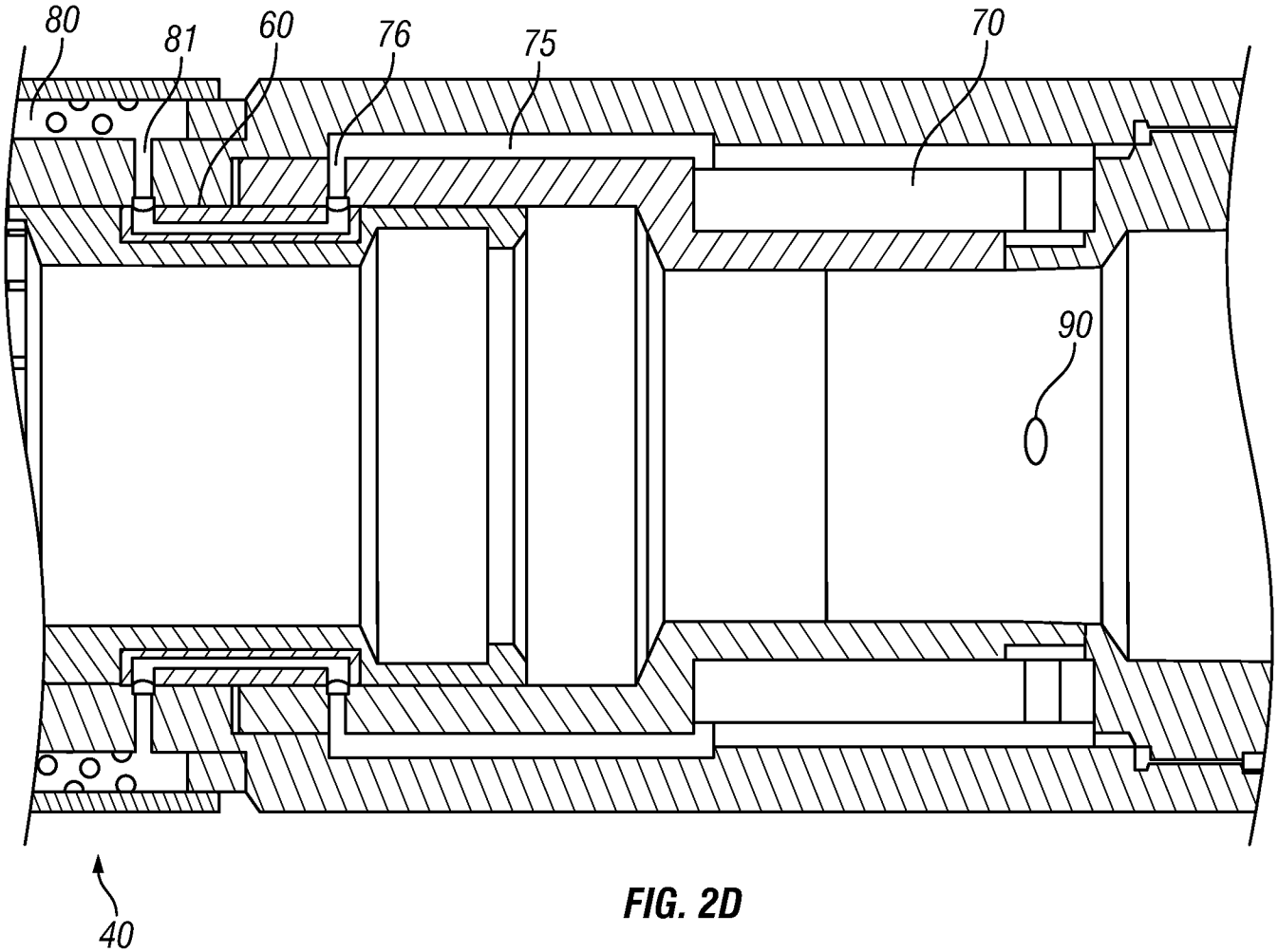
FIG. 2D shows an expansion of the sliding sleeve assembly of the wellbore flow control device when the sliding sleeve assembly is in the open position.

As shown in FIGS. 2A and 2C, when sliding sleeve assembly 60 is in the closed position, a fluid travelling through flow pathway 80 is prevented from reaching flow restricting assembly 70, since access to flow pathway 75 is blocked. FIG. 2C shows an expansion of sliding sleeve assembly 60 of wellbore flow control device 40 when the sliding sleeve assembly is in the closed position, and FIG. 2D shows an expansion of sliding sleeve assembly 60 of wellbore flow control device 40 when the sliding sleeve assembly is in the open position. As shown in FIG. 2C, when sliding sleeve assembly 60 is closed, exit 81 of flow pathway 80 is blocked by sliding sleeve assembly 60, and fluid can progress no further through wellbore flow control device 40. In contrast, as shown in FIG. 2D, when sliding sleeve assembly 60 is open, exit 81 of flow pathway 80 is no longer blocked, and fluid can flow along sliding sleeve assembly 60 to entrance 76 of flow pathway 75. That is, sliding sleeve assembly 60 establishes a flow pathway between exit 81 and entrance 76.

Upon entering flow pathway 75, fluid can then progress through flow restricting assembly 70 prior to entering the interior of wellbore pipe 50 through hole 90, which is in fluid flow communication with flow restricting assembly 70. As described previously, flow restricting assembly 70 can be configured such that it selectively restricts access of desired fluids to the interior of wellbore pipe 50 in order to facilitate production of the desired fluids. In some embodiments, flow restricting assembly 70 can be an autonomous inflow control device.

Figure 3A:
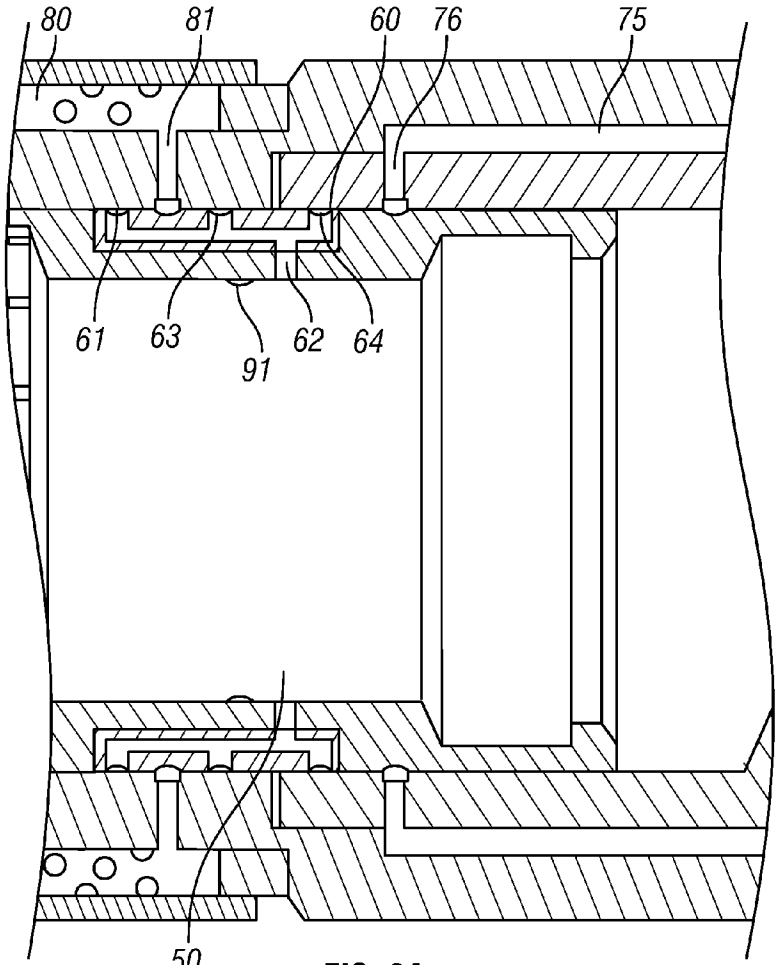
FIGS. 3A-3C show expanded view schematics of an illustrative three-position sliding sleeve assembly in a wellbore flow control device of the present disclosure, where the sliding sleeve assembly can block fluid flow (FIG. 3A), direct fluid flow to a flow restrictor (FIG. 3B), or direct fluid flow directly to the interior of a wellbore pipe (FIG. 3C).
Figure 3B:
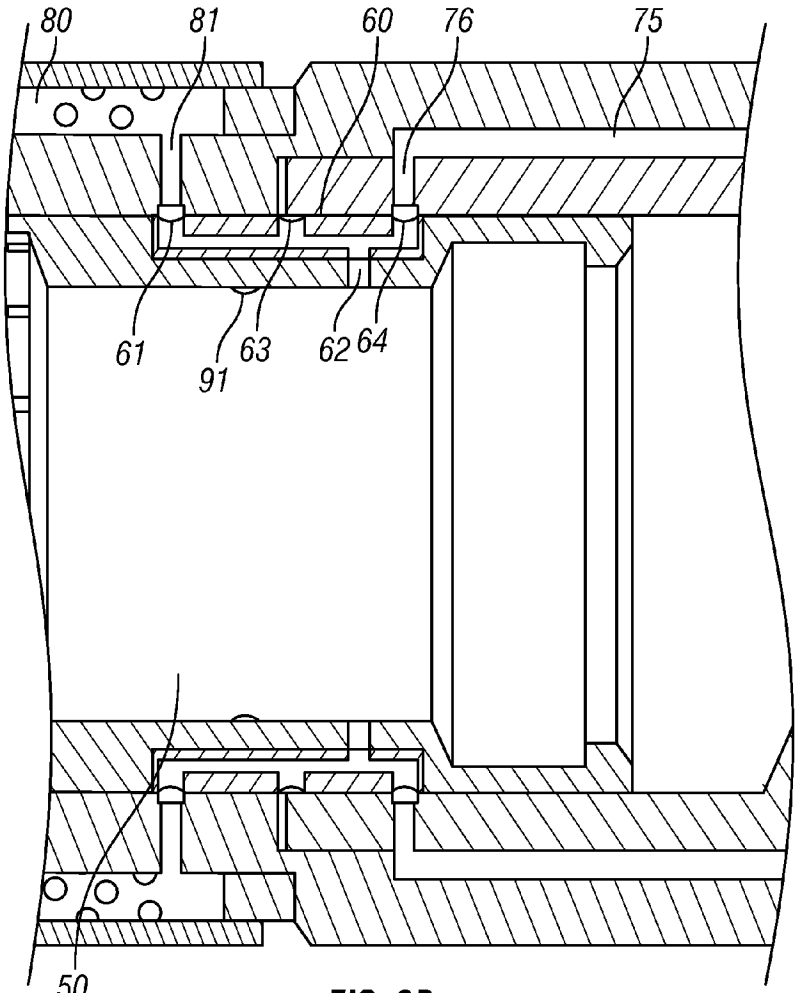
Figure 3C:
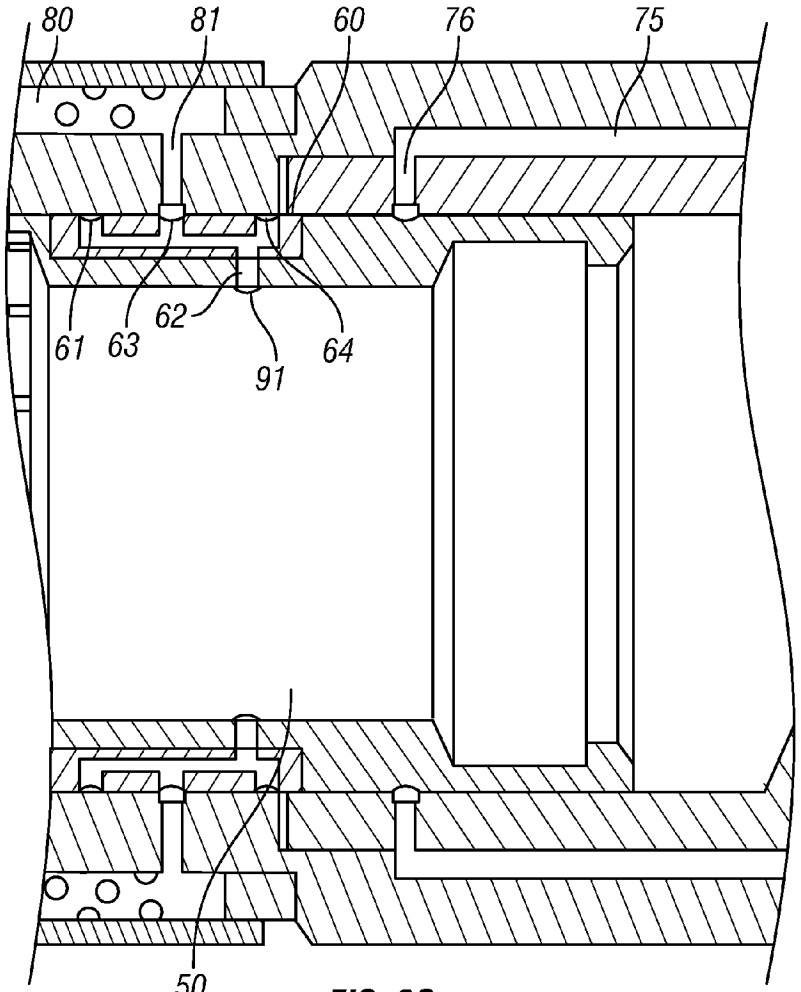

In some embodiments, sliding sleeve assembly 60 of FIGS. 2A-2D can be further configured to divert fluid flow away from flow restricting assembly 70 and directly into the interior of wellbore pipe 50. As presented in FIGS. 2A-2D, sliding sleeve assembly 60 has two positions, where the assembly is either opened or closed. In some embodiments, a sliding sleeve assembly can be configured to divert fluid flow to either flow restricting assembly 70 or the interior of wellbore pipe 50 by making the sliding sleeve at least a three-position sliding sleeve. FIGS. 3A-3C show expanded view schematics of an illustrative three-position sliding sleeve assembly in a wellbore flow control device of the present disclosure, where the assembly can block fluid flow (FIG. 3A), direct fluid flow to flow restricting assembly 70 (FIG. 3B), or direct fluid flow directly to the interior of wellbore pipe 50 (FIG. 3C).

Referring now to FIG. 3A, sliding sleeve assembly 60 can be closed when it is located in a first position in which neither of entrances 61 or 63 on sliding sleeve assembly 60 align with exit 81 of flow pathway 80. Thus, when sliding sleeve assembly 60 is in the first position, fluid flow is blocked by the assembly.

Referring now to FIG. 3B, sliding sleeve assembly 60 can be located in a second position in which it directs fluid flow to flow restricting assembly 70 (not shown) but not to the interior of wellbore pipe 50. When sliding sleeve assembly 60 is located in the second position, entrance 61 on sliding sleeve assembly 60 aligns with exit 81 of flow pathway 80, and exit 64 aligns with entrance 76 on flow pathway 75 to allow a fluid to flow therebetween. From flow pathway 75, a fluid can then progress to flow restricting assembly 70. As shown in FIG. 3B, when fluid flow into entrance 76 occurs, exit 62 on sliding sleeve assembly 60 does not align with entrance 91 on wellbore pipe 50, such that a fluid does not flow to the interior of wellbore pipe 50.

Referring now to FIG. 3C, sliding sleeve assembly 60 can be located in a third position in which it directs fluid flow to the interior of wellbore pipe 50 but does not direct fluid flow to flow restricting assembly 70 (not shown). When sliding sleeve assembly 60 is located in the third position, entrance 63 on sliding sleeve assembly 60 aligns with exit 81 of flow pathway 80, and exit 62 on sliding sleeve assembly 60 aligns with entrance 91 on wellbore pipe 50 to allow a fluid to flow to the interior of wellbore pipe 50. Thus, when sliding sleeve assembly 60 is in the third position, flow restricting assembly 70 can be bypassed when accessing the interior of wellbore pipe 50.

In some embodiments, the wellbore flow control devices described herein can be used in various subterranean operations, particularly to produce a fluid from a subterranean formation. In particular, the wellbore flow control devices can be used during production of a formation fluid from a subterranean formation.

In some embodiments, methods for using the wellbore flow control devices can comprise: installing into an uncompleted wellbore a wellbore pipe that comprises at least one wellbore flow control device, where each wellbore flow control device comprises a sliding sleeve assembly that is in fluid flow communication with a flow restricting assembly and each assembly is located on the exterior of the wellbore pipe, and where the flow restricting assembly is in fluid flow communication with the interior of the wellbore pipe.

In some embodiments, the present wellbore flow control devices can be used to control production from various subterranean zones in which the wellbore flow control devices are deployed. In some embodiments, the present methods can further comprise opening the sliding sleeve assembly of at least some of the wellbore flow control devices, such that a formation fluid can flow through each flow restricting assembly that is in fluid flow communication with each opened sliding sleeve assembly. Doing so can allow access of the formation fluid to the interior of the wellbore pipe such that production can occur therefrom. In some embodiments, the present methods can further comprise producing a formation fluid from the wellbore pipe.

In some embodiments, the present methods can further comprise closing the sliding sleeve assembly of at least some of the wellbore flow control devices in order to isolate a subterranean zone. In some embodiments, the methods can further comprise opening the sliding sleeve assembly of the wellbore flow control devices in at least some of the subterranean zones that were not isolated, and thereafter producing a formation fluid from the wellbore pipe.

During use of the wellbore flow control devices, various techniques can be used to open or close the gate valve assembly according to the present embodiments. Operation of the gate valve assembly can take place manually, electrically, hydraulically, or by like means in various embodiments. In some embodiments, operation of the gate valve assembly, particularly a sliding sleeve assembly, can take place using a tool inserted from the surface down the well string. Tools appropriate for conducting such operations will be familiar to one having ordinary skill in the art.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A wellbore flow control device comprising:

a sliding sleeve assembly movably arranged within a housing coupled to a wellbore pipe and being in fluid flow communication with one or more well screens via a first flow pathway extending upstream of the sliding sleeve assembly; and a flow restricting assembly in fluid flow communication with the sliding sleeve assembly via a second flow pathway, wherein the flow restricting assembly is in fluid flow communication with the interior of the wellbore pipe, wherein the sliding sleeve assembly is movable between a first position, where a formation fluid in the first flow pathway is blocked from accessing the second flow pathway, and a second position, where the formation fluid is able to pass through the sliding sleeve assembly and enter the interior of the wellbore pipe via the second flow pathway.

2. The wellbore flow control device of claim 1, wherein the sliding sleeve assembly is further movable to a third position, where the fluids in the first flow pathway are diverted away from the flow restricting assembly and directly into the interior of the wellbore pipe.

3. The wellbore flow control device of claim 1, wherein the flow restricting assembly comprises a structure selected from the group consisting of an autonomous inflow control device, a non-autonomous inflow control device, tubing, a nozzle, a port, a tortuous path, and any combination thereof.

4. The wellbore flow control device of claim 1, wherein the sliding sleeve assembly is actuated to move either hydraulically or electrically.

5. The wellbore flow control device of claim 1, wherein the sliding sleeve assembly is actuated to move using a tool inserted from a surface into the wellbore pipe.

6. A method comprising:

arranging a wellbore pipe in an uncompleted wellbore, the wellbore pipe comprising:

at least one wellbore flow control device comprising a sliding sleeve assembly movably arranged within a housing coupled to the wellbore pipe and being in fluid flow communication with one or more well screens via a first flow pathway extending upstream of the sliding sleeve assembly; and a flow restricting assembly in fluid flow communication with the sliding sleeve assembly via a second flow pathway and an interior of the wellbore pipe;

moving the sliding sleeve assembly from a first position, where a formation fluid in the first flow pathway is blocked from accessing the second flow pathway, to a second position, where the formation fluid is able to pass through the sliding sleeve assembly and enter the interior of the wellbore pipe via the second flow pathway; and producing the formation fluid from the wellbore pipe.

7. The method of claim 6, further comprising moving the sliding sleeve assembly back to the first position to isolate a subterranean zone.

8. The method of claim 6, further comprising injecting a fluid into a subterranean formation surrounding the wellbore using the wellbore flow control device when the sliding sleeve assembly is in the second position.

9. The method of claim 6, wherein moving the sliding sleeve assembly comprises actuating the sliding sleeve assembly either hydraulically or electrically.

10. The method of claim 6, wherein moving the sliding sleeve assembly comprises actuating the sliding sleeve assembly with a tool inserted from a surface location into the wellbore pipe.

11. The method of claim 6, further comprising moving the sliding sleeve assembly to a third position, where the formation fluid in the first flow pathway is diverted away from the flow restricting assembly and directly into the interior of the wellbore pipe.

12. The method of claim 11, further comprising injecting a fluid into a subterranean formation surrounding the wellbore using the wellbore flow control device when the sliding sleeve assembly is in the third position.

13. The method of claim 6, further comprising regulating a flow of the formation fluid into the interior of the wellbore pipe with the flow restricting assembly, the flow restricting assembly comprises a structure selected from the group consisting of an autonomous inflow control device, a non-autonomous inflow control device, tubing, a nozzle, a port, a tortuous path, and any combination thereof.

* * * * *